US007476128B2

(12) United States Patent
Schmitt

(10) Patent No.: US 7,476,128 B2
(45) Date of Patent: Jan. 13, 2009

(54) ANTI-TWIST ELECTRICAL WIRING TO A PLUG

(76) Inventor: Fred R. Schmitt, Huhnerbrunnele 13, D-74388 Talheim (DE)

( * ) Notice: Subject to any disclaimer, the term of this patent is extended or adjusted under 35 U.S.C. 154(b) by 0 days.

(21) Appl. No.: 12/016,621

(22) Filed: Jan. 18, 2008

(65) Prior Publication Data

US 2008/0176447 A1 Jul. 24, 2008

(30) Foreign Application Priority Data

Jan. 18, 2007 (DE) ..... 20 2007 001 070 U

(51) Int. Cl.
*H01R 13/40* (2006.01)

(52) U.S. Cl. ..... 439/589

(58) Field of Classification Search ..... 439/587–589, 439/271–275, 278, 279, 606
See application file for complete search history.

(56) References Cited

U.S. PATENT DOCUMENTS 6,863,567 B2 * 3/2005 Schmitt ..... 439/589

FOREIGN PATENT DOCUMENTS

EP 1303020 A 4/2003

* cited by examiner

*Primary Examiner*—Javaid Nasri
(74) *Attorney, Agent, or Firm*—Darby & Darby P.C.

(57) ABSTRACT

Electrical wiring has at least one electrical cable, which can be fixed on a round plug-type connector, and a holding apparatus for the cable. The cable ends in the interior of a tubular connecting stub, onto which, at one end, a union nut can be screwed, which nut leaves free a central opening for the cable. A hollow-cylindrical molding is capable of being pressed against the tubular connecting stub in the axial direction by the union nut. The sheath of the cable is capable of being fixed directly or indirectly on the hollow-cylindrical molding. A slotted sleeve is provided in the axial direction between the tubular connecting stub and the hollow-cylindrical molding. This slotted sleeve and the molding are capable of being pushed partially one inside the other. A stop is provided on the molding such that, in the case of rotational twisting of the slotted sleeve, the sleeve can be placed with one of its two free longitudinal edges on the stop. Further, the slotted sleeve has a toothed annular face, with which it can be placed on the tubular connecting stub. The contact faces of the molding and the union nut, which can be positioned so as to press against one another, are each circular cone faces.

19 Claims, 3 Drawing Sheets

ANTI-TWIST ELECTRICAL WIRING TO A PLUG

TECHNICAL FIELD

This application claims priority to German Application No. 202007001070.2 filed Jan. 18, 2007, which is hereby incorporated by reference in its entirety. The invention relates to electrical wiring, with which at least one electrical cable can be connected to a so-called round plug-type connector. The connection region of the cable to the round plug-type connector can be in the form of a plug or socket. Such round plug-type connectors may be precision round plug-type connectors produced in accordance with international standards.

PRIOR ART

EP 1 303 020 A has disclosed wiring which is additionally equipped with strain relief. With this electrical wiring, a tubular connecting stub/union nut constellation is provided by a union nut being screwed, on the one hand, onto a tubular connecting stub and, on the other hand, onto a hollow-cylindrical connecting stub, and thereby these two parts being pressed against one another in the axial direction. The hollow-cylindrical connecting stub then rests inserted between the cable sheath and the cable cores of the connected cable. A sleeve, which has been pushed onto the cable from the outside, pinches in the cable sheath between it and the hollow-cylindrical connecting stub. The pinching forces, which include the strain relief for the electrical cable in question, as a result do not act completely transversely through the cable, but act merely on the cable sheath. As a result of the inability of the hollow-cylindrical connecting stub resting in the cable to deform, the electrical cores or electrical pin elements provided in the interior of the cable or the other electrical contact elements remain unaffected by pinching forces.

As long as the abovementioned parts of the electrical wiring are made from a metallic material, and also the tubular connecting stub, which is usually part of a round plug, is likewise made from a metallic material, an optimum RF (radiofrequency) resistance is provided. Although an existing braided shield is likewise subjected to pinching forces in the radial direction as a result of the sleeve surrounding the sheath when the latter is pinched together, tensile forces acting in the axial direction cannot act on the braided shield because, in the event of corresponding tensile loading of the cable, these tensile forces are absorbed by the sleeve, which presses in the cable sheath between it and the hollow-cylindrical connecting stub. The strain relief prevents tensile forces, which act in the axial direction from the outside on the cable sheath of an electrical cable, from displacing the cable sheath in relation to the cable cores provided in the interior of the cable. Otherwise, the mechanical firm fit of the cable cores in their respective contact-making position could be lost.

This electrical wiring has proven effective from a technical point of view, but the union nut, which holds together the individual parts of the wiring in the axial direction, needs to be screwed onto the tubular connecting stub, which protrudes through the opening of a housing wall or correspondingly projects from a round plug-type connector, with very high tightening forces. When the union nut is screwed on, a sealing ring provided between it and the molding is compressed in the axial direction. During the screwing-on process, the required screw-on forces are reduced by the axial tension relief (expansion) of this sealing ring occurring in the process. The union nut therefore needs to be tightened with a correspondingly high force in order to prevent the union nut from becoming unscrewed unintentionally, for example in the case of very severe shaking movements or similar impact loads acting on the wiring.

DESCRIPTION OF THE INVENTION

Against the background of this previously known prior art, the invention is based on the object of specifying technically problem-free wiring, which is equipped with antitwisting means preventing undesired unscrewing of the union nut.

This invention is provided by the features of the main claim.

Developments of the invention are the subject matter of further claims following on from this claim.

The invention contains a conical design of the contact faces of the union nut and the molding which bear against one another. The invention therefore makes use of the knowledge that cone faces only detach from one another under the action of very high forces. The conical design of the contact faces between the union nut and the molding therefore prevents the union nut from being twisted unintentionally in relation to the molding and therefore being capable of being unscrewed from the tubular connecting stub.

In order to now allow for destruction-free detaching of the union nut from the connecting stub at all, a spacer sleeve, which is arranged in the axial direction between the molding and the tubular connecting stub and is in the form of a longitudinally slotted toothed ring sleeve, has a slot and its annular front edge, which faces this toothed ring sleeve, has a stop, which protrudes radially out of the circular cross section of the front edge and is circumferentially smaller than the opening angle of the longitudinal slot provided in the toothed ring sleeve. As a result, the toothed ring sleeve can twist to and fro until one or the other longitudinal edge of its longitudinal slot bears laterally against the stop.

This twisting to and fro of the toothed ring sleeve together with the union nut, which is fixedly suspended in a friction-locking manner via the cone faces, and of the molding means that the union nut also twists, corresponding to the rotation to and fro of the toothed ring sleeve, correspondingly in relation to the outer thread of the tubular connecting stub on which it is screwed.

As a result of this twisting of the union nut, the latter is displaced to a very small degree in the axial direction, together with the molding. As a result, it is possible for the molding to be displaced by this very small axial amount towards the tubular connecting stub, in relation to the union nut. As a result of this axial displacement, the press fit between the contact faces of the molding and the union nut is loosened to such an extent that the union nut can then be completely unscrewed with relatively low forces from the tubular connecting stub. During this final unscrewing process, the molding only needs to be held with a slight force in order to prevent it from also rotating when the union nut is unscrewed.

The union nut can therefore only be unscrewed from the tubular connecting stub and therefore the wiring can only be screwed on if the union nut is first twisted around a small region and then the subregion protruding out of the wiring is pushed with the cable simultaneously into the wiring axially. These two conditions triggering loosening of the press fit between the molding and the union nut are not provided at the same time in the event of even very strong shaking forces acting on the wiring, with the result that effective protection against undesired detaching of the wiring is provided.

The circumferential angle of the stop provided on the molding is approximately between 20° (degrees) and 60°

(degrees), in particular 30° (degrees). The circumferential angle of the longitudinal slot in the toothed ring sleeve is larger than this and is approximately between 90° (degrees) and 150° (degrees), in particular approximately 120° (degrees).

The cone angle between the contact faces of the union nut and the molding, on the one hand, and the longitudinal axis of the wiring, on the other hand, is approximately 5° (degrees) to 15° (degrees), in particular approximately 7° (degrees).

If in the case of the wiring according to the invention strain relief is provided, this strain relief contains a hollow-cylindrical connecting stub, which is provided such that it protrudes in the axial direction on the molding and which is fitted to the cable sheath of the cable to be connected from the inside of the cable. A further sleeve can be positioned in the cross-sectional area of the hollow-cylindrical connecting stub on the cable in such a way that the cable sheath can be fixed on the wiring in such a way that it is pinched in between the further sleeve and the hollow-cylindrical connecting stub. So-called strain relief produced thereby prevents tensile forces acting on the cable from being transmitted to the electrical cores provided in the interior of the cable or other contact-making elements. The construction parts holding the cable in pinching fashion, namely the sleeve, which is provided on the outside of the sheath, on the one hand, and the hollow-cylindrical connecting stub, which is provided on the inside of the sheath, on the other hand, also mean that these cores can be loaded by pinch forces when the sheath is pinched firmly.

The protruding, hollow-cylindrical connecting stub can either be integrally connected to the molding or can be fixed, such as in particular riveted or else welded, on the molding.

Hollow-cylindrical moldings can either be provided in an axially extended, straight form or in an angled form. The angled end region of the hollow-cylindrical molding is then located in particular outside the clearance of the union nut.

Further configurations and advantages of the invention are given by the features further listed in the claims and the following exemplary embodiments.

BRIEF DESCRIPTION OF THE DRAWING

The invention will be described and explained in more detail below with reference to the exemplary embodiments illustrated in the drawing, in which.

APPROACHES FOR IMPLEMENTING THE INVENTION

Figure 1:
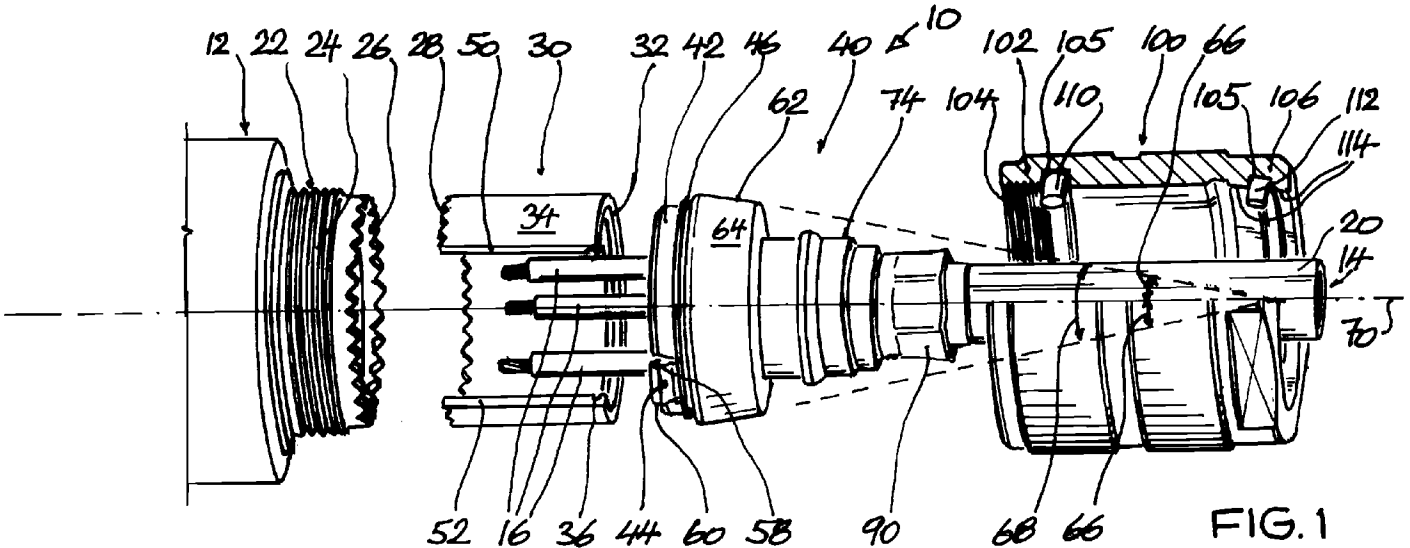
FIG. 1 shows a perspective, exploded illustration of wiring according to the invention in the case of a round plug-type connector.
Figure 5:
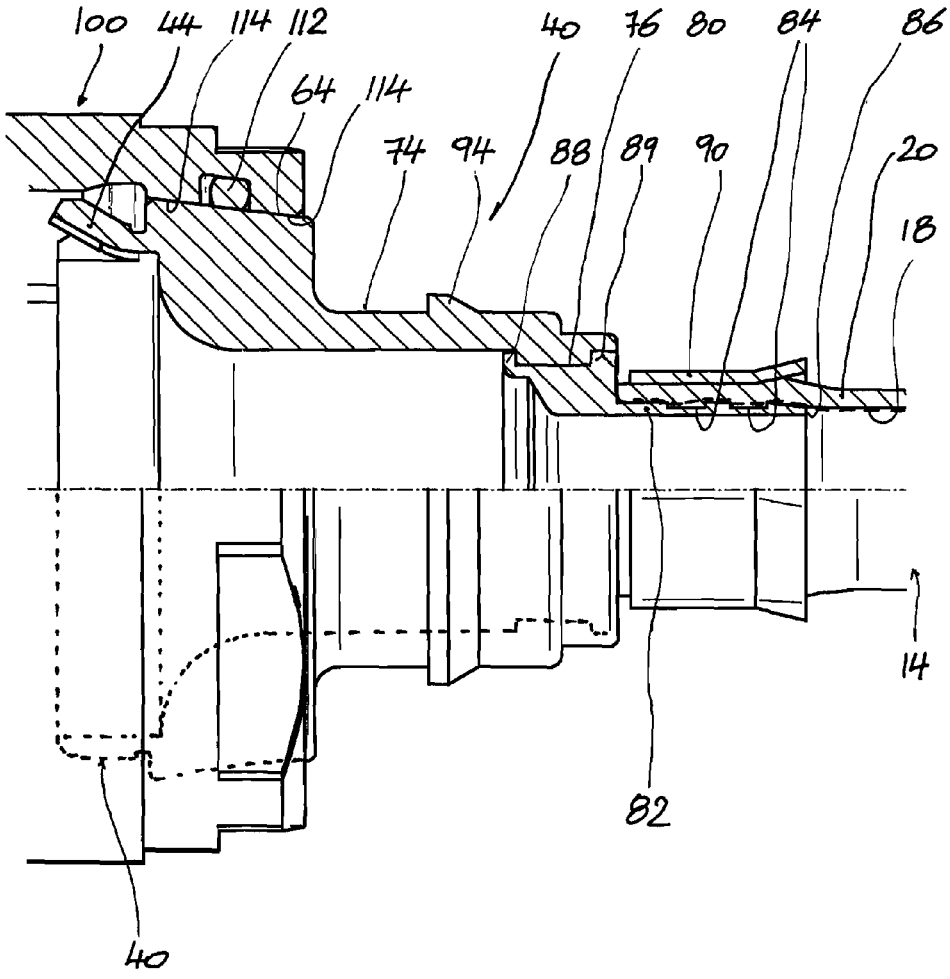
FIG. 5 shows an enlarged, partially sectioned view of the wiring in the region of its molding.

With the wiring 10 illustrated in FIG. 1, a round plug-type connector 12 with its connection region in the form of a plug for a cable 14 is provided. The round plug-type connector 12 could also be provided in the form of a socket. An electrical cable 14 can be fixed in the round plug-type connector 12. This cable 14 has a plurality of cores 16, which are enveloped by a conventional electrically conductive braided shield 18 (FIG. 5). The braided shield 18 is for its part surrounded by the cable sheath 20. The design of such a cable 14 is known with different cores and also with or without a braided shield.

The round plug-type connector 12 has a tubular connecting stub 22, which is provided with an outer thread 24. The right-hand end of this tubular connecting stub 22 illustrated in FIG. 1 has a toothed front face 26.

This toothed front face 26 of the tubular connecting stub 22 is in engagement, in the assembled state of the wiring 10, with a comparably toothed front face 28, which is formed on the left-hand (in FIG. 1) end of a longitudinally slotted toothed ring sleeve 30. The other front-side end with respect thereto in the axial direction of this toothed ring sleeve 30 has a planar front face 32. At an axial distance in front of this front face 32, an annularly peripheral annular groove 36 is formed in the sheath 34 of the toothed ring sleeve 30.

In the assembled state of the wiring 10, the toothed ring sleeve 30 is provided between the round plug-type connector 12 and a molding 40. This molding 40 has a circular-cylindrical sheath region 42 at its left-hand (in FIG. 1) end, from which sheath region 42 a subregion, representing a stop 44, is bent out radially towards the outside from the circular region of the sheath region 42. The circular-cylindrical sheath region 42 has a peripheral annular bead 46. In the assembled state of the toothed ring sleeve 30 and molding 40, the annular bead 46 rests in the annular groove 36 of the toothed ring sleeve 30.

Figure 2:
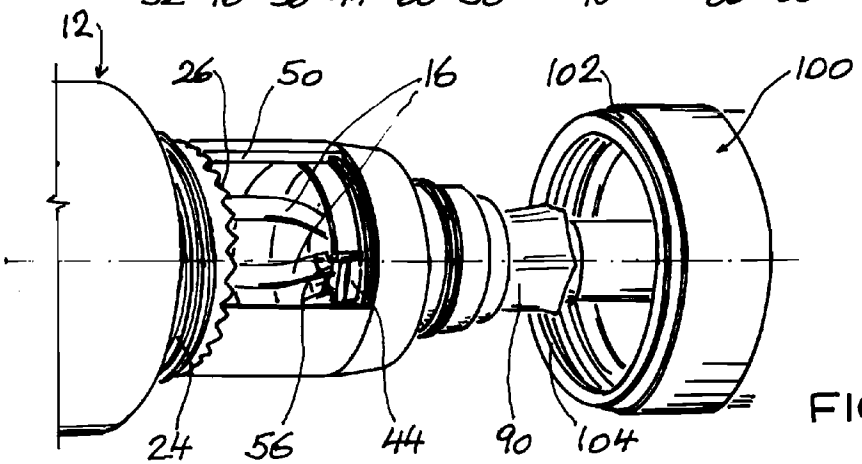
FIG. 2 shows a view of the wiring shown in FIG. 1, in the partially fitted state.
Figure 3:
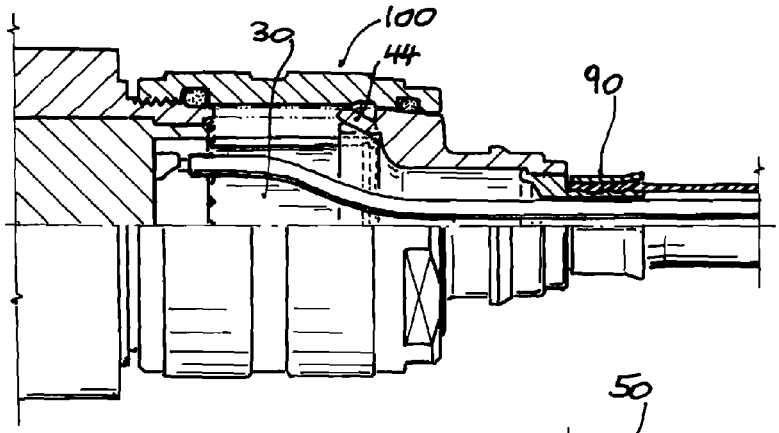
FIG. 3 shows a partially sectioned side view of the wiring shown in FIG. 1.
Figure 4:
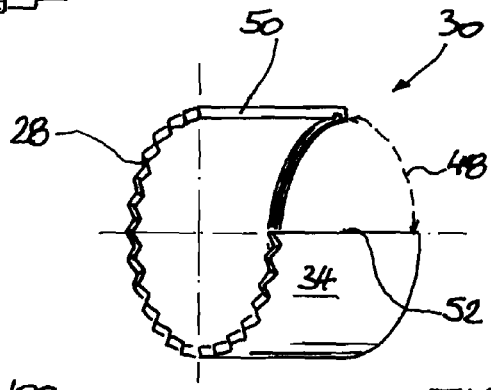
FIG. 4 shows a perspective view of the toothed ring sleeve provided in the wiring.

The longitudinal slot of the toothed ring sleeve 30 is laterally delimited by the two longitudinal edges 50, 52 of its sheath 34. The circumferential opening angle 48 between these two longitudinal edges 50, 52 in the present example is approximately 120° (degrees) (FIG. 4). This opening angle 48 is approximately three to four times as large as the circumferential angle 56 between the two stop sides 58, 60 of the stop 44, which circumferential angle defines the circumferential expansion of this stop 44. This circumferential angle 56 in the present example is approximately 30° (degrees). The toothed ring sleeve 30 can either bear with its one longitudinal edge 50 against the one stop side 58 of the stop 44 or, as is illustrated in FIG. 2, with its other longitudinal edge 52 against the other stop side 60 of the stop 44. This is utilized when detaching the wiring 10, which will be described in more detail further below.

In front of its circular-cylindrical sheath region 42, the molding 40 has a truncated cone section 62 with circular cross sections determined by the physical shape of the wiring 10. The sheath face 64 of this truncated cone section 62 has a cone angle 66 of, in the present example, approximately 7° (degrees) with respect to the longitudinal axis 70. The opening angle 68 of the sheath face 64 is twice as large and in this example is therefore approximately 14° (degrees).

An annular part 74 bears against the truncated cone section 62 of the molding 40. At a short distance in front of its right-hand (in FIG. 5) end, the annular part 74 has a shoulder 76 in the form of a circular ring which springs radially inwards. This shoulder 76 engages from the inside around a sleeve, which is referred to as a crimping flange 80. The crimping flange 80 ends in a sleeve-shaped tip 82. The outer sheath face of this tip 82 in the present example has two peripheral, annular depressions 84. The front end of this tip 82 has a conical tapering 86. The crimping flange 80 engages with a front and rear annular shoulder 88, 89 around the shoulder 76 provided on the molding 40. Both parts, the molding 40 and the crimping flange 80, are fixedly connected to one another. This mutual fixed connection is produced in the present example by means of riveting, which is not especially illustrated in the drawing.

When the wiring 10 is assembled, first the cable 14 is fixed on the molding 40. For this purpose, the cores 16 are exposed and the cable sheath 20 is correspondingly cut to size. Then, the tip 82 of the crimping flange 80 is pushed from the left (based on FIG. 5) beneath the cable sheath 20 and in the process also beneath the braided shield 18 of the cable, 14 which is indicated by dashed lines in the drawing. The braided shield 18, which is covered at the top by the cable sheath 20, therefore lies directly on the sleeve-shaped tip 82. The crimping flange 80 is therefore pushed beneath the cable sheath 20 with the molding 40 fixed on it. Then, a sleeve, which is pushed onto the cable 14 in advance, a so-called crimping sleeve 90, is pushed onto the end region of the cable sheath 20 and compressed from the outside by corresponding pressing tools and in the process deformed in the manner of a polygon. This state is illustrated in FIG. 5. The cable sheath 20 is held together with the braided shield 18 in such a way that it is pressed in between the crimping sleeve 90 and the sleeve-shaped tip 82. The cable sheath 20 and therefore the cable 14 is fixed in this way, with tensile strength, on the crimping flange 80 and therefore on the molding 40. This so-called crimping technique is known in principle. The annular part 74 of the molding 40 has a radially protruding annular shoulder 94. A shrink hose, which is pushed onto the annular part 74 and the cable sheath 20, obtains an additional hold on the molding 40 by means of this shoulder 94.

Then, the cores 16 of the cable 14 are now connected to the round plug-type connector. Then, the toothed ring sleeve 30 is clipped on the molding 40 and then the molding 40 is pushed with the toothed ring sleeve 30 against the tubular connecting stub 22 of the round plug-type connector 12. This state is illustrated in FIG. 2. Then, a union nut 100, which is positioned on the cable sheath 20, is pushed over the molding 40 and fixedly screwed on the round plug-type connector 12. For this purpose, the union nut 100 has a front section 102 with an inner thread 104. This front section 102 can be used to screw the union nut 100 onto the tubular connecting stub 22. In order to protect against the ingress of water, an annular groove 105 is provided in the union nut 100 in the front section 102, adjacent to the inner thread 104, and a sealing ring 110 rests in said annular groove 105.

An annular groove 105 is also provided shaped into the rear section 106 of the union nut 100, and a sealing ring 112 rests in said annular groove 105 in order to prevent the ingress of water into the cable connection region beneath the union nut 100 from this axial direction as well.

The rear section 106 has an inner conical face, which has the same cone angle 66 as the sheath face 64 of the truncated cone section 62 of the molding 40. In the fitted state, i.e. in the state in which the union nut 100 is screwed on the tubular connecting stub 22, which state is illustrated in enlarged form in FIG. 5, the conical contact faces of the two parts, which contact faces bear against one another in pressing fashion, i.e. the likewise conical inner face 114 of the rear section 106 of the union nut 100, which is shaped in opposite fashion and bears in pressing fashion against the conical sheath face 64 of the truncated cone section 62 of the molding 40, prevent the union nut 100 from being capable of being twisted in relation to the molding 40 when the wiring 10 is detached. The molding 40 would therefore always be twisted along with the union nut 100 if the union nut 100 should be unscrewed from the tubular connecting stub 22. It is nevertheless possible to unscrew the union nut 100 from the tubular connecting stub 22 in a destruction-free, simple manner. This takes place as follows.

When the union nut 100 is screwed onto the tubular connecting stub 22, the toothed ring sleeve 30 is located, for example, in the position illustrated in FIG. 2 in relation to the stop 44 of the molding 40. As soon as the contact faces between the truncated cone section 62 and the rear section 106 of the union nut 100, i.e. the conical sheath face 64 of the truncated cone section 62 and the conical inner face 114 of the union nut 100, come into frictional contact with one another, the union nut 100 will also involve the molding 40 in the rotary movement during its screw-on movement onto the tubular connecting stub 12. As a result, the stop 44 will move towards (based on FIG. 2) the longitudinal edge 50 of the toothed ring sleeve 30. In the process, the toothed ring sleeve 30 will not also be twisted as a result of its toothed engagement in the toothed front face 26 of the tubular connecting stub 22.

As a result of the firm fit between the union nut 100 and the molding 40 in the region of the conical contact faces of these two parts, unintentional, undesired unscrewing of the union nut 100 from the tubular connecting stub 22 is not possible.

For unscrewing purposes, the union nut 100 is unscrewed from the tubular connecting stub 22 slightly. This detaching and the twisting of the union nut 100 taking place in the process at the same time also brings about corresponding twisting of the molding 40 and the cable 14 fixed thereto. This concomitant twisting takes place, as has already been mentioned, as a result of the friction-locking fixed contact in the region of the cone faces of the union nut 100 and of the molding 40. During this unscrewing process and the resultant twisting of the union nut 100 and the molding 40, the toothed ring sleeve 30 does not twist as well. This prevents its toothed engagement in the tubular connecting stub 22. The slight twisting when the union nut 100 is unscrewed is, however, only possible until the stop 44 of the molding 40 has moved towards the other longitudinal edge 52 of the toothed ring sleeve 30 and bears against it firmly. This state is illustrated in FIG. 2.

The union nut 100 is still screwed on the tubular connecting stub 22, but is no longer completely screwed on. This partial unscrewing brings about a very small axial movement of the molding 40 away from the tubular connecting stub 22. In the present example, this axial enlargement of the distance between the molding 40 and the tubular connecting stub 22 of the round plug-type connector 12 is approximately 0.15 millimeter. The toothed front face 28 of the toothed ring sleeve 30 also moves away from the toothed front face 26 of the tubular connecting stub 22 in the axial direction by this very small amount of 0.15 millimeter. As before, the toothed, mutual engagement of the tubular connecting stub 22 and the toothed ring sleeve 30 is still provided, however. As a result of the molding 40 being pressed axially in the direction of the tubular connecting stub 22 by this small amount of 0.15 millimeter, the sheath face 64 of the truncated cone section 62 of the molding 40 moves very slightly away from the inner face 114 of the union nut 100; the pressing contact fit between the molding 40 and the union nut 100 is loosened at least to such an extent that the union nut 100 can then be twisted in relation to the molding 40 and therefore completely unscrewed from the tubular connecting stub 22 with only a very small amount of force expenditure. The molding 40 can now be drawn axially away from the round plug-type connector 12 towards the right (based on FIG. 2), then the toothed ring sleeve 30 can be removed from the molding 40 and then the exposed cores 16 detached from the round plug-type connector 12.

Figure 6:
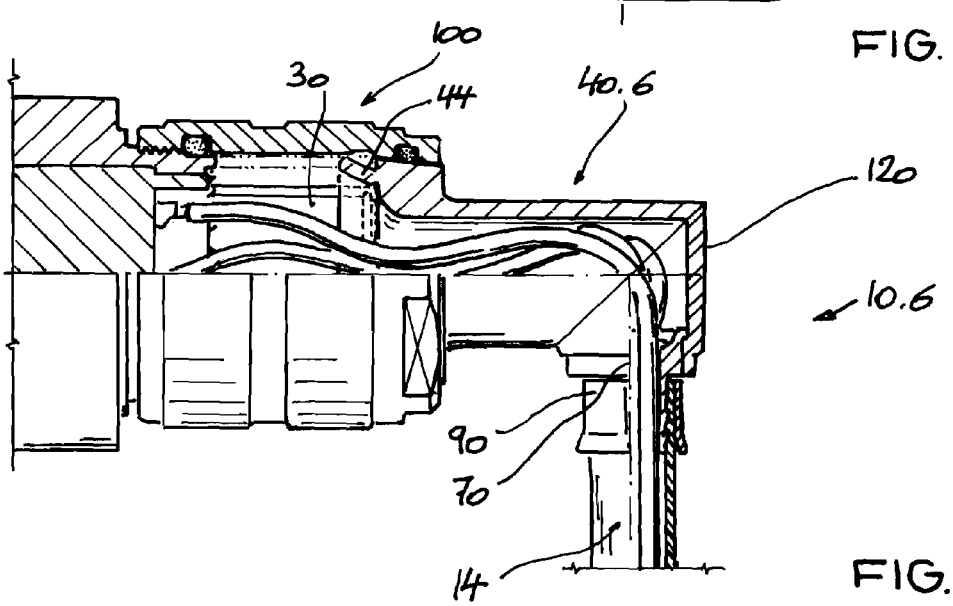
FIG. 6 shows a partially sectioned view of wiring according to the invention similar to that in FIG. 3, with an angled cable entry.

The wiring 10.6 illustrated in FIG. 6 differs from the above-described wiring 10 to the extent that the annular part 74.6 of the molding 40.6 has a 90 degree bend 120. At the free end of the bend 120 there is the same connection for a cable 14 which is also provided in the protruding annular part 74. To this extent, reference is made to the illustrations in the preceding figures and to their descriptions.

The invention claimed is:

1. Electrical wiring with at least ore electrical cable, which can be fixed on a round plug-type connector, the cable ending in the interior of a tubular connecting stub, onto which, at one end, a union nut, which leaves a central opening for the cable free, can be screwed, a hollow-cylindrical molding being capable of being pressed against the tubular connecting stub in the axial direction by the union nut, a sheath of the cable being capable of being fixed directly or indirectly on the hollow-cylindrical molding, and a holding apparatus for the cable comprising:

a slotted sleeve is provided in the axial direction between the tubular connecting stub and the hollow-cylindrical molding, the slotted sleeve and the molding being capable of being pushed partially one inside the other, a stop being provided on the molding such that in the case of rotational twisting of the slotted sleeve, said sleeve can be placed with, in each case, one of its two free longitudinal edges on the stop, the slotted sleeve has a toothed annular face, with which it can be placed on the tubular connecting stub, contact faces of the molding and the union nut which can be positioned so as to press against one another, are each circular cone faces.

2. Wiring according to claim 1, wherein the circumferential angle of the stop is approximately 20° (degrees) up to 60° (degrees).

3. Wiring according to claim 2, wherein a circumferential angle of the stop is approximately 30° (degrees).

4. Wiring according to claim 1, wherein the opening angle of a slot of the slotted sleeve is approximately 90° (degrees) to 150° (degrees).

5. Wiring according to claim 4, wherein an opening angle of the slot of the slotted sleeve is approximately 120° (degrees).

6. Wiring according to claim 1, wherein a cone angle between the contact faces of the union nut and the molding and the longitudinal axis is approximately 5° (degrees) to 15° (degrees).

7. Wiring according to claim 6, wherein the cone angle between the contact faces of the union nut and the molding and the longitudinal axis is approximately 7° (degrees).

8. Wiring according to claim 1, wherein a first sleeve is provided on the molding so as to project in the axial direction and be placed beneath the cable sheath of the cable, a second sleeve can be positioned in the cross-sectional region of the first sleeve on the cable and can be pressed firmly against the cable sheath, so that the holding apparatus, which comprises the slotted sleeve, the molding, the first sleeve and the second sleeve, can be placed in clamping fashion on the cable sheath simultaneously from beneath the cable sheath and from the outside of the cable.

9. Wiring according to claim 8, wherein the molding is integrally connected to the first sleeve.

10. Wiring according to claim 8, wherein the first sleeve is fixed, such as in particular riveted, on the molding.

11. Wiring according to claim 1, wherein the tubular connecting stub, the slotted sleeve, the union nut, the molding and the first sleeve are made from a metallic material.

12. Wiring according to claim 1, wherein the hollow-cylindrical molding has an angled shape, so that its longitudinal axis is provided in angled form.

13. Wiring according to claim 12, wherein the molding has an angled end region, this angled end region is provided outside the region of the union nut, which is screwed onto the molding, a first sleeve is provided at the free end of the angled end region.

14. Wiring according to claim 13, wherein the first sleeve is fixed, such as, in particular riveted, on the angled molding.

15. Wiring according to claim 1, wherein a sealing ring is provided between the union nut and the tubular connecting stub.

16. Wiring according to claim 15, wherein the sealing ring rests in an annular groove, which is provided in the union nut.

17. Wiring according to claim 16, wherein the sealing ring rests in an annular groove, which is provided in the union nut.

18. Wiring according to claim 1, wherein a sealing ring (112) is provided between the union nut and the hollow-cylindrical molding.

19. Wiring according to one of claims 8, 9, 10, 13 and 14, wherein the first sleeve is integrally connected to the hollow-cylindrical molding.

* * * * *